US010960634B2

(12) United States Patent
Reischer et al.

(10) Patent No.: US 10,960,634 B2
(45) Date of Patent: Mar. 30, 2021

(54) DEVICE FOR OPENING AN END REGION OF A TUBULAR BAG BODY

(71) Applicant: STARLINGER & CO GESELLSCHAFT M.B.H., Vienna (AT)

(72) Inventors: Martin Reischer, Furth an der Triesting (AT); Emanuel Jank, Pottenstein (AT)

(73) Assignee: STARLINGER & CO GESELLSCHAFT M.B.H., Vienna (AT)

( * ) Notice: Subject to any disclaimer, the term of this patent is extended or adjusted under 35 U.S.C. 154(b) by 283 days.

(21) Appl. No.: 16/317,617

(22) PCT Filed: Jul. 10, 2017

(86) PCT No.: PCT/EP2017/067206
§ 371 (c)(1),
(2) Date: Jan. 14, 2019

(87) PCT Pub. No.: WO2018/011114
PCT Pub. Date: Jan. 18, 2018

(65) Prior Publication Data

US 2019/0291379 A1 Sep. 26, 2019

(30) Foreign Application Priority Data

Jul. 14, 2016 (EP) ..... 16179471

(51) Int. Cl.
*B31B 70/00* (2017.01)
*B31B 150/00* (2017.01)
(Continued)

(52) U.S. Cl.
CPC ..... *B31B 70/003* (2017.08); *B31B 70/00* (2017.08); *B31B 2150/00* (2017.08);
(Continued)

(58) Field of Classification Search
CPC ... B31B 70/003; B31B 70/00; B31B 2150/00; B31B 2160/10; B31B 2150/003;
(Continued)

(56) References Cited

U.S. PATENT DOCUMENTS 3,913,463 A * 10/1975 Hollis ..... B31B 50/00 493/256
4,319,444 A * 3/1982 Russell ..... B43M 7/00 53/284.3
(Continued)

FOREIGN PATENT DOCUMENTS

AT 408 427 B 11/2001
DE 82 34 461 6/1983
(Continued)

OTHER PUBLICATIONS

PCT/EP2017/067206, Sep. 28, 2017, International Search Report and Written Opinion.

*Primary Examiner* — Hemant Desai
*Assistant Examiner* — Christopher Robin Kim
(74) *Attorney, Agent, or Firm* — Workman Nydegger

(57) ABSTRACT

A device for opening an end region of a bag body, which end region extends between an open tube body end and a bottom central line, having a transporting device, on which the bag body is transportable with adjacent tube walls at a transport rate (V) in a transporting direction, and suction devices arranged on both sides of the bottom central line, which are driven so as to be moveable transversely back and forth to the transporting direction, wherein the suction devices are movable in addition in the transporting direction back and forth. The suction devices are mounted at first articulated joints, wherein at each first articulated joint there are hinged two pivoting arms pivoting relative to one other, wherein each pivoting arm is pivotingly connected to a positioning
(Continued)

Figure 1:
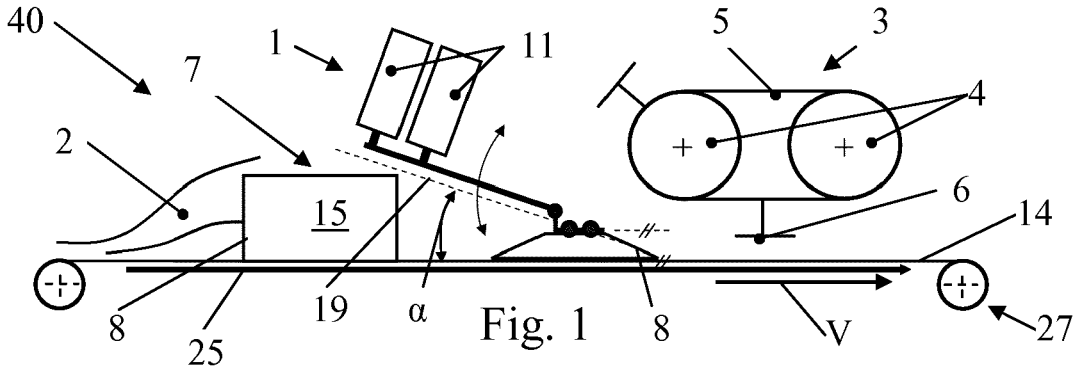

pivoting arm by means of a second articulated joint and wherein each positioning pivoting arm is movably driven.

13 Claims, 4 Drawing Sheets

(51) Int. Cl.
*B31B 160/20* (2017.01)
*B31B 160/10* (2017.01)

(52) U.S. Cl.
CPC . *B31B 2150/003* (2017.08); *B31B 2150/0014* (2017.08); *B31B 2160/10* (2017.08); *B31B 2160/20* (2017.08)

(58) Field of Classification Search
CPC ..... B31B 2160/20; B31B 2150/0014; B31B 50/07; B31B 50/12; B31B 50/76; B31B 50/804; B65B 43/18; B65B 43/30
USPC ..... 493/309–319; 53/459, 564, 570, 384.1, 53/386.1
See application file for complete search history.

(56) References Cited

U.S. PATENT DOCUMENTS 4,617,785 A * 10/1986 Chikatani ..... B65B 43/34 53/562
5,564,252 A * 10/1996 Adelmann ..... B65B 1/02 53/202
5,845,463 A * 12/1998 Henaux ..... B65B 9/093 53/450
6,477,820 B1 * 11/2002 Dutra ..... B65B 43/30 53/412
9,260,212 B2 * 2/2016 Monti ..... B65B 43/305
9,902,514 B1 * 2/2018 Ishikawa ..... B65B 59/005
10,273,042 B1 * 4/2019 Kolodziey ..... B65D 5/54
2002/0116898 A1 * 8/2002 Ikemoto ..... B65B 43/30 53/386.1
2004/0110619 A1 * 6/2004 Frank ..... B31B 50/80 493/309
2004/0238128 A1 * 12/2004 Giro Amigo ..... B65B 51/146 156/494
2006/0207225 A1 * 9/2006 Fukuda ..... B65B 43/30 53/492
2007/0197364 A1 * 8/2007 Monti ..... B65B 43/305 493/316
2008/0000198 A1 * 1/2008 Setozaki ..... B65B 43/30 53/396
2008/0098697 A1 * 5/2008 Murray ..... B65D 75/5883 53/457
2008/0300123 A1 * 12/2008 Bonnain ..... B65B 43/265 493/310
2009/0093354 A1 * 4/2009 Johnson ..... B65B 43/265 493/52
2009/0233779 A1 * 9/2009 Klein ..... B65B 43/185 493/315
2011/0053747 A1 * 3/2011 Haeger ..... B31B 70/00 493/210
2013/0156352 A1 * 6/2013 Koehn ..... B31B 70/00 383/84
2014/0360133 A1 * 12/2014 Yoshikane ..... B65B 43/30 53/386.1
2016/0280409 A1 * 9/2016 Verma ..... B65D 33/007
2017/0137179 A1 * 5/2017 Chaturvedi ..... B31B 70/262
2018/0126683 A1 * 5/2018 Johnson ..... B31B 50/07
2019/0127100 A1 * 5/2019 Matsumura ..... B65B 43/30

FOREIGN PATENT DOCUMENTS

EP 2 441 574 B1 5/2013
EP 2 711 164 A1 6/2016

* cited by examiner

DEVICE FOR OPENING AN END REGION OF A TUBULAR BAG BODY

The invention relates to a device for opening an end region of a tubular bag body, according to the preamble of claim 1.

Box-like bags, which are also called cross bottom bags, are bags having a box-shaped form, which are produced in bag producing plants, by tubular bag bodies being provided, the open end regions of which are folded into cross bottoms. When being folded, the bag bodies are conveyed in a flat manner through the production plant so that the tube walls of the tubular bag body are adjacent to one another, in particular also at the end regions of the tubular bag body. In order to form the bottom, the two tube walls are then separated from one another at the end regions of the tubular bag and folded over by 180°, wherein at least one of the two tube walls is folded over by means of a spreading tool as a side flap onto itself, whereby an open bottom is produced, in which the other tube walls forms a second side flap. By folding over one tube wall at the end region of the tubular bag body, there is produced at the front and back part of this end region respectively a triangular corner fold. This process is called "unraveling" in the art. Consequently, for the production of bag valve bags, valve sheets may be inserted, which are formed into a valve by a further folding process, by means of which the bags may be filled through a filling nozzle. The final bottom configuration is produced by folding over of the bottom side flaps in an overlapping way. The overlapping bottom side flaps are, depending on the material of the bag body, glued or thermally welded. Alternatively or additionally thereto, bottom cover sheets may be placed onto the overlapping bottom side flaps and then glued or welded thereto.

Such a bag production plant is described in the patent AT 408 427 B. With the bag production plant known, the required indexed operation of this plant has proven to be disadvantageous, which poses high requirements for the drives and limits the throughput of bag bodies to be processed. The expenditure of time for the periodic unraveling of the bottoms, including the required fixation of the unraveled bottoms, may even represent an upper limit for the performance of the entire device for producing bags.

This disadvantage has been overcome by the device for forming open bottoms of bag bodies disclosed in the EP 2 441 574 B1, in which the bag body portions are conveyed in a continuous way. The bottom opening device, by means of which the two layers at the end region of the tubular bag body are separated from each other, is, according to this document, formed as a pneumatic bottom opening device, in which there are provided suction devices opposite in regard to the material layers to be separated, which engage at the tube walls of the bag body and, as a consequence, are moved apart from each other, thus separating the tube walls from one another, so that the spreading tool may engage therebetween. In regard to the embodiment of the bottom opening device, there are not given any further details in this document.

In the patent application EP 2 711 164 A1, there is described an electrically driven bottom opening device, in which the suction devices are attached to holders. The holders may be moved back and forth, transversely to the transporting direction, by means of parallel pivoting arms, whereby the end region of the tubular bag body may be opened. The parallel pivoting arms are mounted in an articulated way on a carriage, which may be moved back and forth in a guiding rail in an inclined direction, driven across a toothed belt. The inclined direction is inclined at an angle to the transporting direction, wherein the inclined direction is oriented in the transporting direction. Due to the embodiment of the device, the end region of the tubular bag body may be opened during a transport of the bag body in the transporting direction on the transport device, wherein the carriage, when opening the end region of the bag body, for each bag body will be moved therewith in a linear way for a short period of time.

The device known from the patent application EP 2 711 164 A1 has proven to be disadvantageous in so far as the device will be subject to high wear, due to a high mass when opening the end regions of moved parts, in particular with high production rates required. This wear will be further increased due to the high proportion of linear movement. The drive also includes belts, which are also subject to wear. This all will lead to increased maintenance efforts and maintenance costs. Further there is given the disadvantage due to the embodiment of the device that, on the basis of the high masses to be moved, the transport rate of the transport device will be limited, as in the case of high transport rates the device will not be able to keep up with the transport rate and repeating accuracy, when opening the end regions, will be lost. For this reason, the production rate of a production facility provided with this known device is limited.

It is the task of the present invention to provide a device for opening an end region of a tubular bag body, which enables the opening of end regions of the tubular bag bodies at high transport rates of the transport device in order to increase the production rate of production facilities.

According to the invention, this task is solved by the provision of a device for opening an end region of a tubular bag body having the features of claim 1. Advantageous embodiments of the invention are set forth in the sub-claims.

The inventive device is configured to open an end region of a tubular bag body, which end region extends between an open tube body end and a bottom central line. A transport device transports the bag bodies with adjacent tube walls in a bag conveying plane at a transport rate in a transporting direction, wherein the bottom central line is oriented in the transporting direction. On both sides of the bottom central line, there are arranged suction devices that are driven to be moved transversely to the transporting direction back and forth and which are movable to abut at the tube walls of the end region of the bag bodies situated therebetween and which are moveable apart from one another under exertion of a suction force onto the respective tube wall, thus pulling the tube walls apart from one another, wherein the suction devices in addition is moveable in and opposite to the transporting direction. The suction devices are mounted at first articulate joints, wherein at each first articulate joint there are hinged two pivoting arms pivoting in relation to one another, wherein each pivoting arm is connected to a positioning pivoting arm by means of a second articulate joint, wherein each positioning pivoting arm being movably driven.

By the inventive embodiment of the device, the suction devices may be driven at a higher rate, whereby, in comparison to prior art, the transport rate of the transport device may be increased and, hence, the production rate of bags may be further increased.

By the embodiment of the devices, there is further obtained the advantage that the mass of device and in particular the mass of the moved parts of the device may be reduced in comparison to the device known from prior art, whereby less energy has to be provided in order to open the end regions of the bag bodies.

Advantageously, each positioning pivoting arm is driven by its own positioning drive. Thereby, there is obtained the advantage that the suction devices may be moved arbitrarily under consideration of the geometrical dimensions of the positioning pivoting arms and of the pivoting arms transversely to the transport direction and in the transport direction in one plane. The plane is in the following designated as working plane. Due to the arbitrary movement of the suction devices in the working plane, each point in the working plane may be reached, which is why the device is suitable for various bag formats.

In a further embodiment variant, the positioning pivoting arms are driven pair-wise by a positioning drive, wherein there are optionally mounted levers or gears between the positioning drive and at least one of the positioning pivoting arms. Thereby, there is obtained the advantage that a complex control of the positioning drive may be omitted in order to move the suction devices always in the exactly same trajectory in the working plane.

The working plane is advantageously oriented at an angle to the bag conveying plane, wherein the angle may be preferably adjusted. Due to the adjustability of the angle of the working plane, the inventive device may especially easily adapted for unraveling bottoms of different width and bag bodies having different width. For narrow bottoms, there is thereby selected an angle of 0° or a flat angle to the bag conveying plane, and for wider bottoms, there may be set a steeper angle. With such a configuration, there is further ensured that the opening device transfers the opened end region correctly to the subsequent processing station, in particular to a spreading device, without there having to be accepted an unguided or undefined, respectively, state between the opening of the end region and the further processing thereof.

The suction devices may usefully be moved, in particular for opening the end regions of the bag bodies, in a circumferential trajectory having the following positions:

- a first position, in which the suction devices rest at or near the bottom central line at the adjacent tube walls of the end region of the bag body,
- a second position, in which the suction devices have been moved in regard to the first position in the transporting direction and away from one another,
- a third position, in which the suction effect of the suction devices is turned off, wherein the third position is situated at or near the point of return of the circumferential trajectory from the movement in the transporting direction into a movement opposite to the transporting direction, and
- a fourth position, which is situated at or near a point of return of the circumferential trajectory from the movement opposite to the transporting direction into a movement in the transporting direction.

When the suction devices return from the fourth position again into the first position, then there has already been positioned a further bag body in the meantime by the transport device, the end region of which will be opened upon the subsequent passing of the positions. By passing the four positions, there is ensured that the same circumferential trajectory will be passed for opening the end regions of the bag bodies, whereby there is obtained the advantage that the end regions of the tubular bag bodies will always be correctly opened and that, by way of a further processing station, in particular a spreading device, an open bottom may be formed at the end regions. There is further obtained the advantage that a path distance for opening the end region of the tubular bag body and for another return into the first position for opening the end region of a successive bag body will be as short as possible.

The circumferential trajectory advantageously has the form of an elliptical trajectory.

The suction devices are preferably mounted at holders opposing one another, wherein the device in addition has orienting arms, which hold the holders opposing one another in parallel upon movement in the working plane. Thereby there is obtained the advantage that the holders and suction devices will always be oriented compulsorily in the same way, whereby the end region of the tubular bag body may be opened with repetitive accuracy.

The transport rate of the transport device and, hence, the production rate of bags may be increased once more if the pivoting arms, the orienting arms and/or the positioning pivoting arms have recesses. By the provision of recesses, the mass moment of inertia of the pivoting arms, the orienting arms and the positioning pivoting arms will be reduced, whereby the entire construction may be faster accelerated. Advantageously, the pivoting arms, the orienting arms and/or the positioning pivoting arm are made from a material as light as possible such as aluminium, magnesium or plastic material.

The holders and the suction devices are advantageously configured as light as possible and made from aluminium or plastic material, or a combination of these materials.

In particular if a bottom opening device in a bag production facility for bag bodies from air-permeable fabrics is to be used, there is given the risk that when positioning the suction devices to the tube walls there will occur air suction through the tube walls, whereby the suction device will not suck only the tube wall assigned thereto but rather also the tube wall situated behind, hence no separation of the layers will be made. In order to prevent this, the present invention is developed preferably such that suction devices opposing one another in the transport direction are arranged offset to one another, thereby engaging the tube walls to be separated in a way offset to one other.

A positioning drive is preferably configured by a stepper motor, a servo-motor, a hydraulically driven motor or a pneumatically driven motor.

In order to prevent the tube walls of the end region becoming distorted during the opening process, it is favourable if the suction devices are moved, when opening the end region—during the contact thereof with the tube walls-, at a rate in the working plane, the rate component of which being equal to the transport rate.

Each holder advantageously carries several suction devices, wherein the suction devices are arranged at each of the holders in at least one row. In this way there is obtained the advantage that upon exertion of a suction force the tube walls are flatly sucked, thereby preventing a deformation of the tube pieces.

The holders are preferably configured to be adjustable such that the rows of suction devices are oriented in parallel to the bag conveying plane. Thereby there is obtained the advantage that the holders are always oriented in the same way to the bag conveying plane.

Depending on the requirement for the bags to be produced, there may be formed bottoms at both opposing end regions of the tubular bag body, or only one bottom may be formed at one end region. If there are to be formed bottoms at both end regions, then there will be used an inventive device in order to open each of the end regions, wherein the devices are advantageously arranged offset to one other. Thereby, there is obtained the advantage that, also in the case of tubular bag bodies having a short length, both end regions may be opened and adjustment of the device due to lack of space may be omitted.

Further advantageous embodiments of the inventive device are explained in greater detail in the following by way of the figures.

Figure 2:
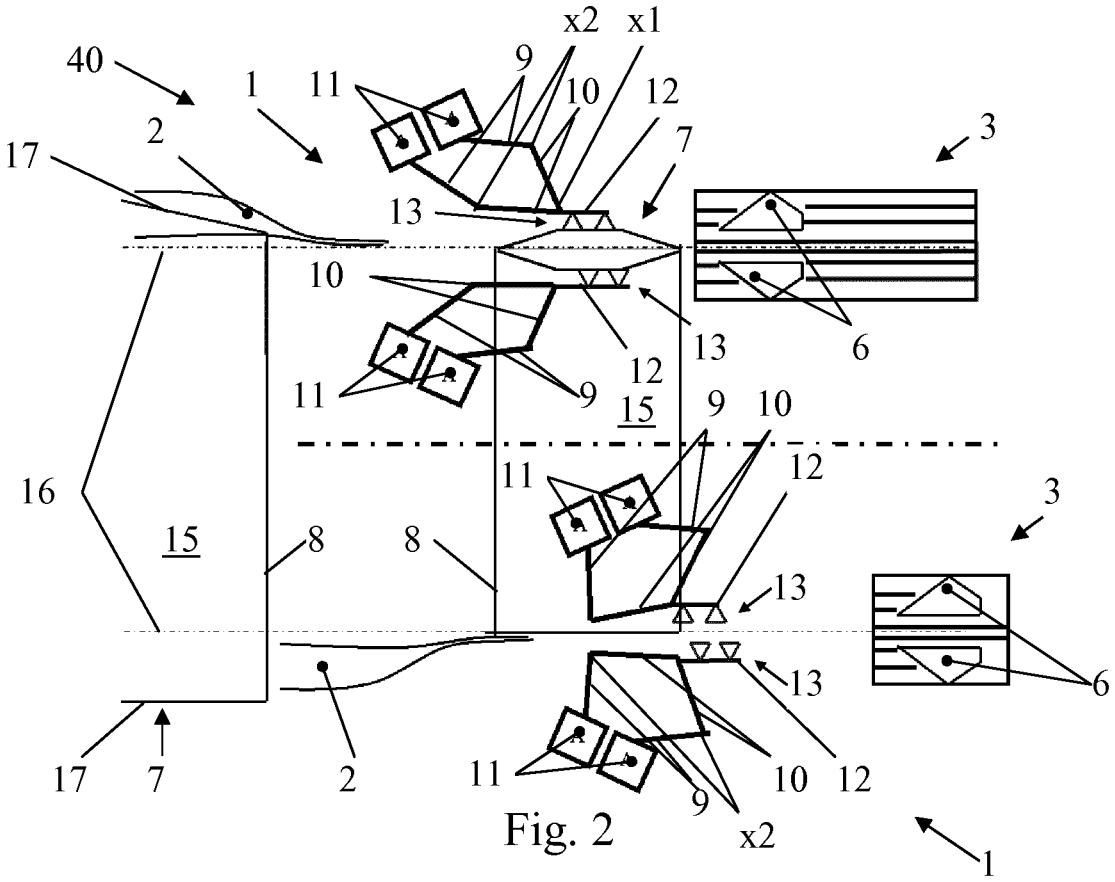

The FIGS. 1 and 2 show schematic views of an embodiment variant of a system for forming open bottoms in open end regions of tubular bag bodies, in which system there are used inventive devices for opening the end regions of the tubular bag bodies.

Figure 3:
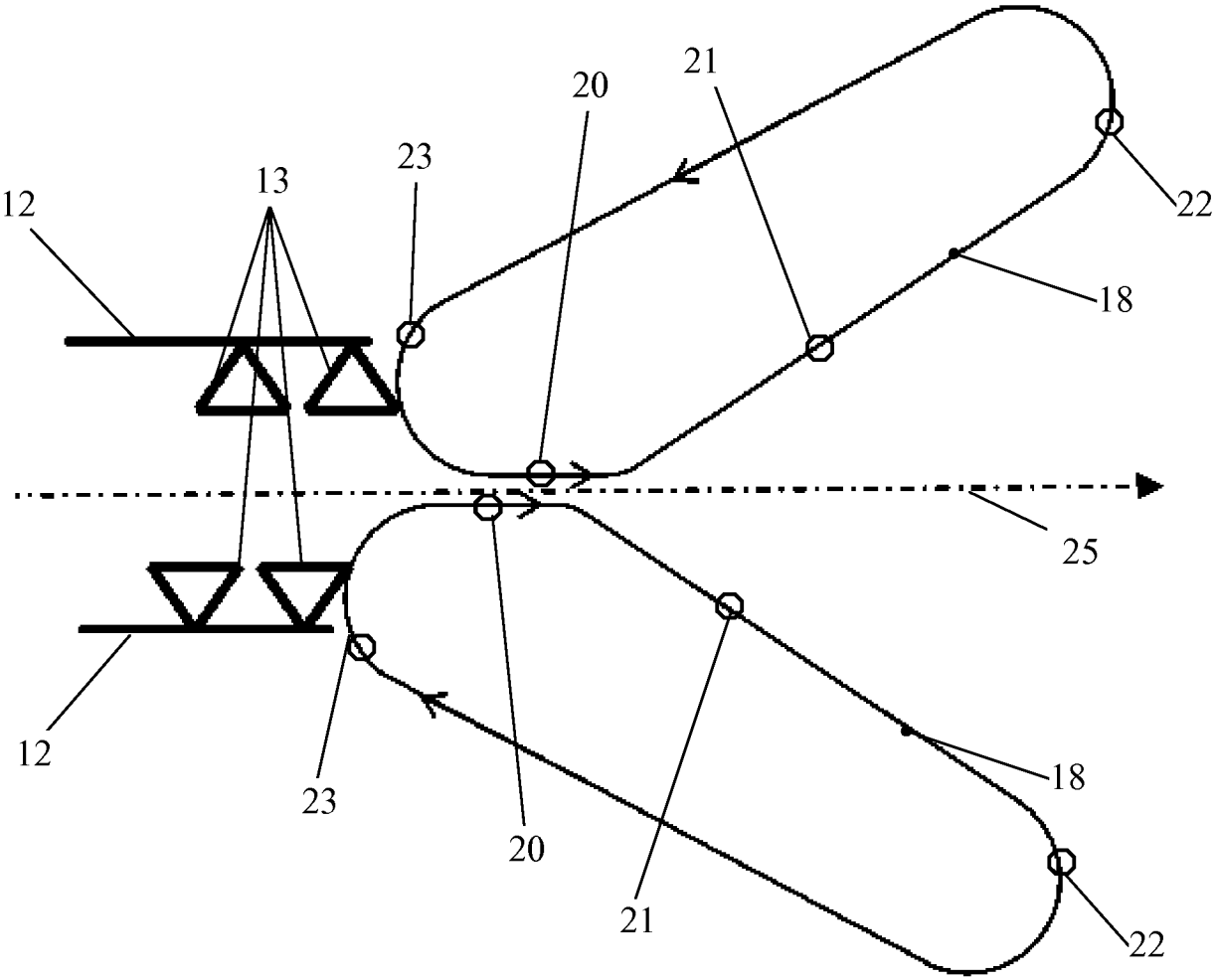

FIG. 3 schematically shows essentially elliptical circumferential trajectories, which the suction devices of the inventive device that is used in the system according to FIG. 1 have to pass in order to repeatedly open end regions of successive bag bodies.

The FIGS. 4 to 7 schematically show positions of pivoting arms and positioning pivoting arms of the inventive device that is used in the system according to FIG. 1 when passing the essentially elliptical circumferential trajectory according to FIG. 3.

The FIGS. 1 and 2 schematically show views of an embodiment variant of a system 40 for forming open bottoms at open end regions 7 of tubular bag bodies 8, in which system 40 inventive devices 1 for opening the end regions 7 of the tubular bag bodies 8 are used, wherein FIG. 1 shows the system 40 in a schematical side view and FIG. 2 shows the system 40 in a schematical top view. The system 40 further includes two erecting devices 2 in the form of baffles and two spreading devices 3. The spreading devices 3 each include two rollers 4 and a belt 5 mounted on the rollers 4 and driven by the rollers 4, which holds and drives a spreading device 6. The embodiment of the spreading devices 3 and the embodiment of the erecting devices 2 correspond to the embodiments of the spreading device and the erecting device known from the patent EP 2 441 574 B1.

A transport device 27 transports the bag bodies 8 with adjacent tube walls 15 continuously at a transport rate V in the transporting direction 25 in a bag conveying plane 14. The transport device 27 is formed by a belt conveyor.

The open end regions 7 of the bag bodies 8 are formed opposing one another in the bag bodies 8, wherein one device 1 for opening an end region 7 is provided at one side of the bag body 8. The end regions 7 each extend between a bag body end 17 and a bottom central line 16, wherein the bottom central lines 16 are each oriented in the transporting direction 25. For reasons of space requirements of the devices 1, the devices 1 are arranged offset to one another.

Each device 1 includes four positioning pivoting arms 9, four pivoting arms 10, four positioning drives 11, two holders 12 and four suction devices 13, wherein respectively two suction devices 13 are arranged attached to a holder 12. The two suction devices 13, which are each attached to a holder 12, are attached thereto in a row and symbolized by two triangles. Each device 1 further has four orienting arms 24, which always hold the holders 12 in parallel to one another during a movement of the holders 12. For reasons of clarity, the orienting arms 24 are only depicted in the FIGS. 4 to 6. The orienting arms 24 are movably connected, preferably via a ball bearing, to one another, to the holders 12 and to the positioning drives 11 or to a housing of the positioning drives 11.

As is visible in FIG. 2, respectively one holder 12 is driven by means of two positioning drives 11, wherein the positioning pivoting arms 9 are each connected with one end to a drive shaft of a positioning drive 11 and with the other end in an articulated way by means of a second articulated joint x2 to a pivoting arm 10. The pivoting arms 10 are connected at one of the ends thereof by means of a first articulated joint x1 rotatably to the holders 12. The positioning drives 11 are advantageously configured by stepped motors or servo-motors. By means of the positioning drives 11, the holders 12 may be arbitrarily moved in a working plane 19, wherein the working plane 19 is oriented at an angle $\alpha$ to the bag conveying plane 14.

The positioning drives 11 are oriented in parallel to one another and, by means of not-depicted holdings, attached to fixed elements of the transport device 27 such that this is mounted rotatably in regard to the bag conveying plane 14 and may be fixed at various angles to the bag conveying plane 14. The positioning drives 11 are further attached in regard to the fixed elements of the transport device 27 such that a distance between positioning drives 11 and the bag conveying plane 14 is modifiable. The first articulated joints x1 are configured such that they are clampeable about the horizontal, whereby the rows of suction devices 13 may be oriented always in parallel to the bag conveying plane 14 at various angles $\alpha$.

By changing the angle of the position drives 11 and the distance of the position drives 11 in regard to the bag conveying plane 14, the angle $\alpha$ of the working plane 19 and the distance of the working plane 19 in regard to the bag conveying plane 14 may be arbitrarily adapted, whereby the system 40 may be adjusted in a simple way to bottoms having various widths and to bag bodies 8 having various widths.

The process for folding up the end regions 7 of a tubular bag body 8 will be explained in greater detail in the following. For reasons of simplicity, this process will only be described by way of an end region 7 visible to the left in the transporting direction 25. The process of folding up for the end region 7 visible to the right in the transporting direction 25 is performed in the same way, but due to the offset arrangement of the erecting devices 2, of the inventive devices 1 and of the spreading devices 3 it will be offset in time.

Firstly, the bag bodies 8 rest in a flat manner on the transport device 27, wherein the bag bodies 8 are conveyed at a transport rate V by the transport device 27 in the transporting direction 25. In this state, the tube walls 15 of the tubular bag bodies 8 rest one upon the other. The bag bodies 8 are advantageously secured against slipping on the transport device 27 by means of holding means not depicted. If a tubular bag body 8 passes the erecting device 2, the end region 7 of the bag body 8 is folded over essentially orthogonally along the bottom central line 16 to the remaining bag body 8. See FIG. 2.

In the following, the suction devices 13 of the devices 1 are brought into contact in a first position 20 with the tube walls 15 of the end regions 7 of the bag bodies 8 that have been folded over, wherein the rate of the suction device 13, driven by the positioning drives 11, is adjusted to the transport rate V. The first position 20 is depicted in FIG. 3. The tube walls 15 are sucked by a suction forced applied onto the tube walls 15 by the suction device 13. From this point on, a rate component of the holders 12 in the transporting direction 25 will correspond to the transport rate V of the transporting device 27, whereby distortion of the tube walls 15 upon opening the end region 7 will be prevented. Then the two holders 12 and the suction device 13 arranged thereto start to move apart from one another, thereby opening the end region 7. FIG. 2 shows in the upper area an end region 7 of a tubular bag body 8 already opened by the device 1. Subsequently, the suction force will be interrupted, and the suction devices 13, controlled by the positioning drives 11, will be moved back into the first position 20, wherein the suction device 13 or the holders 12, respectively, will pass an essentially elliptical circumferential trajectory 18 for opening the end region 7 and for the subsequent return into the first position 20. See FIG. 3. The end regions 7 opened by the device 1 will subsequently be folded apart by the spreading device 3 and formed into open bottoms, whereby in further steps that are not depicted there may be formed a bag bottom.

FIG. 3 shows schematically essentially elliptical circumferential trajectories 18, which are passed by the holders 12 and the suction devices 13 of the inventive device 1, used in the system 40 according to FIG. 1, for repeatedly opening end regions 7 of successive bag bodies 8.

Figure 4:
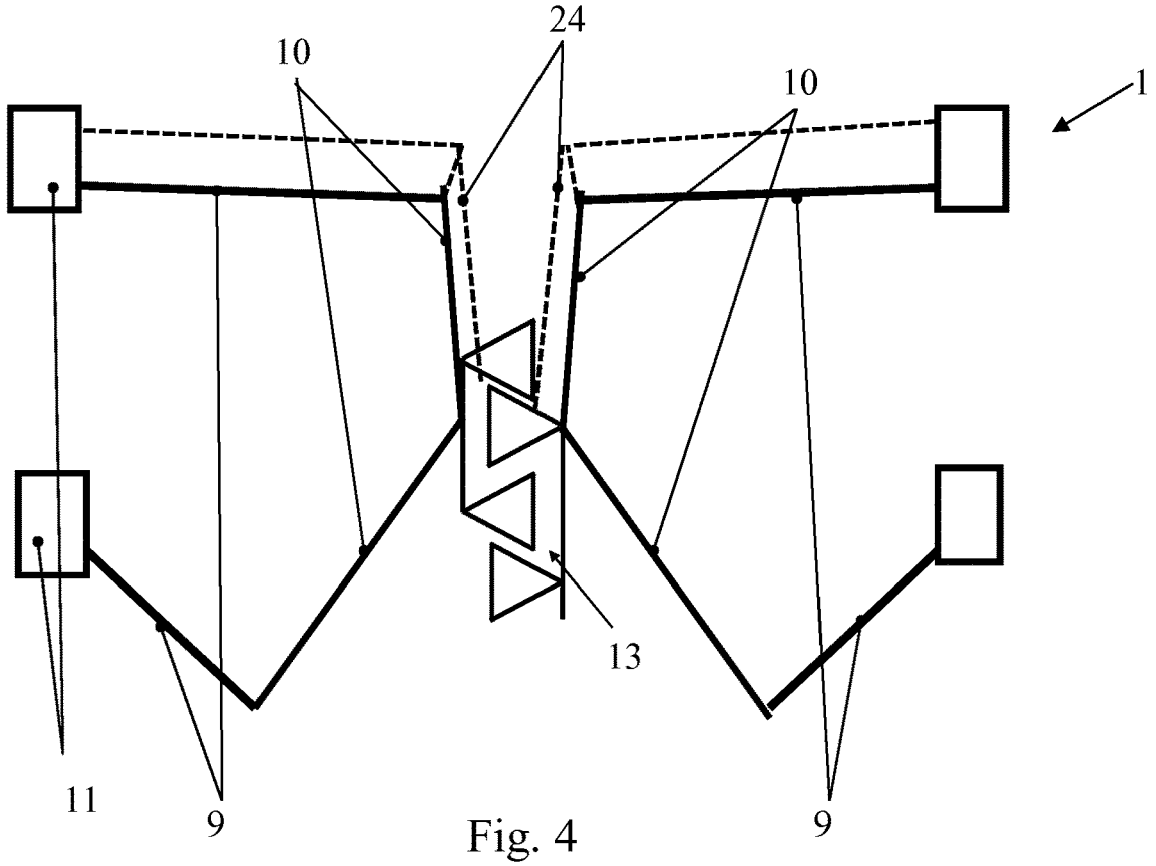

If the suction devices 13 are in the first position 20, then the suction devices 13 essentially abut the tube walls 15 of the end region 7. For reason of better clarity, the tube walls 15 are not depicted in FIG. 3. In order to prevent suction of a tube wall 15 by another tube wall 15, by means of which as a consequence there would not occur separation of the layers, the suctions devices 13 or the holders 12, respectively, are arranged offset to one another for opening an end region 7. By application of a suction force, respectively one tube wall 15 will be temporarily coupled to respectively one holder 12. A position of the positioning pivoting arms 9 and of the pivoting arms 10 with the holding in the first position 20 is depicted in FIG. 4. For opening the end region 7, the positioning drives 11 are controlled such that the holders 12 or the suction devices 13, respectively, follow the essentially elliptical circumferential trajectory 18, wherein the holders 12 are always kept in parallel to one another by the orienting arms 24. In this way, the tube walls 15 are separated from each other, wherein, due to the inclination of the working plane 19 to the bag conveying plane 14 about the angle $\alpha$, the tube walls 15 are folded in the direction of the bag conveying plane 14 when passing the essentially elliptical circumferential trajectory 18.

Figure 5:
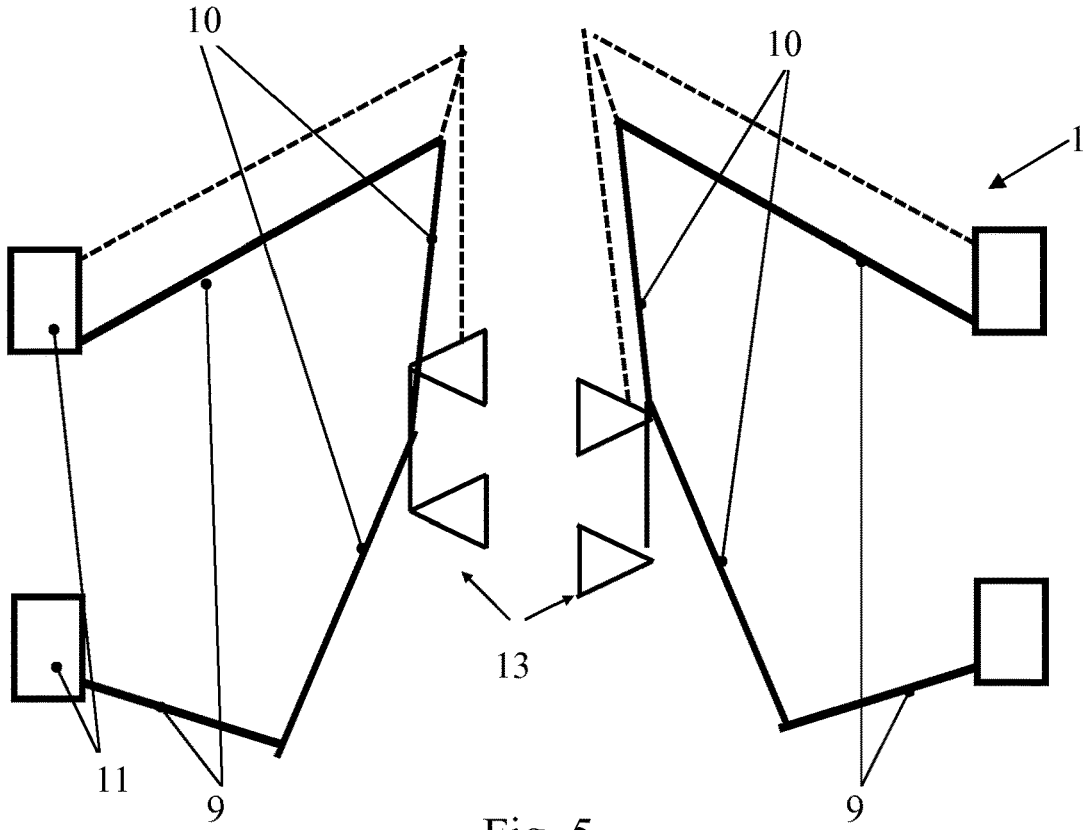

FIG. 5 shows the holders 12 in a second position 21, already spaced apart from each other in part. If the holders 12 or the suction devices 13, respectively, reach a third position 22, the suction force will be interrupted and the suction devices 13 will be released from the tube walls 15. The rate component of the holders 11 in the transporting direction, when passing the essentially elliptical circumferential trajectory 18 from the first position 20 into the third position 22, is equal to the transport rate V.

Figure 6:
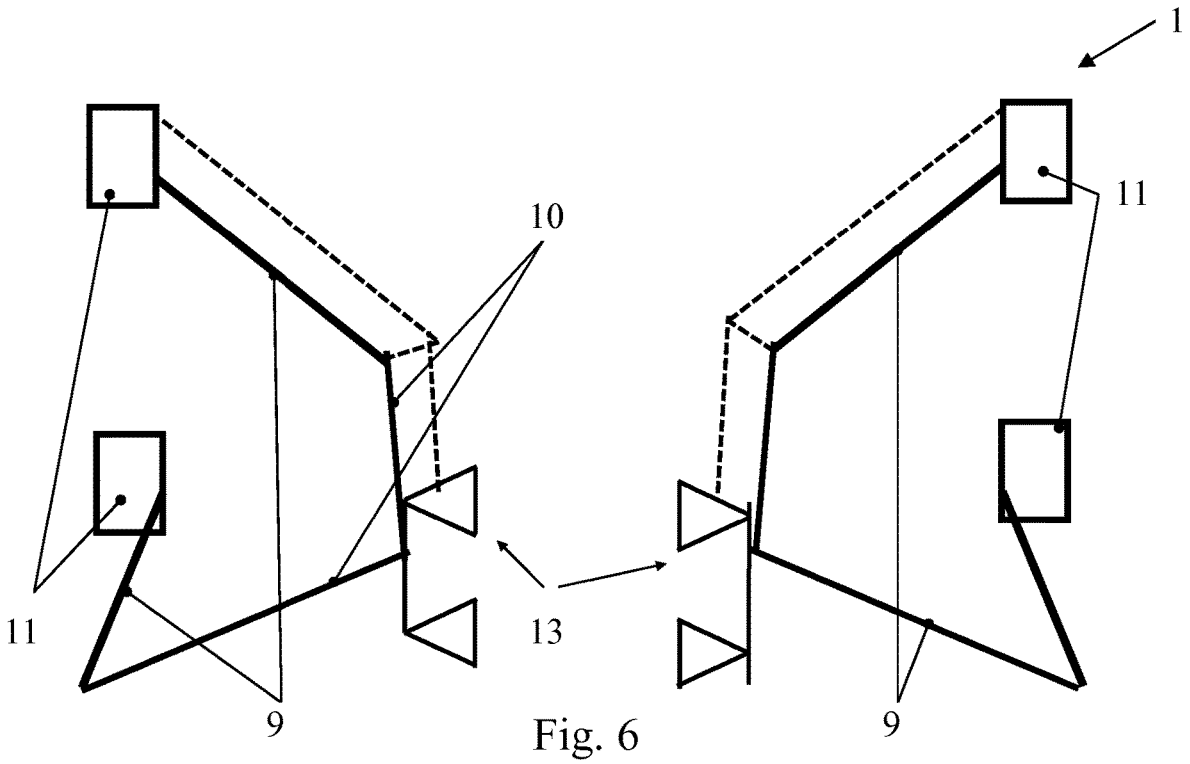
Figure 7:
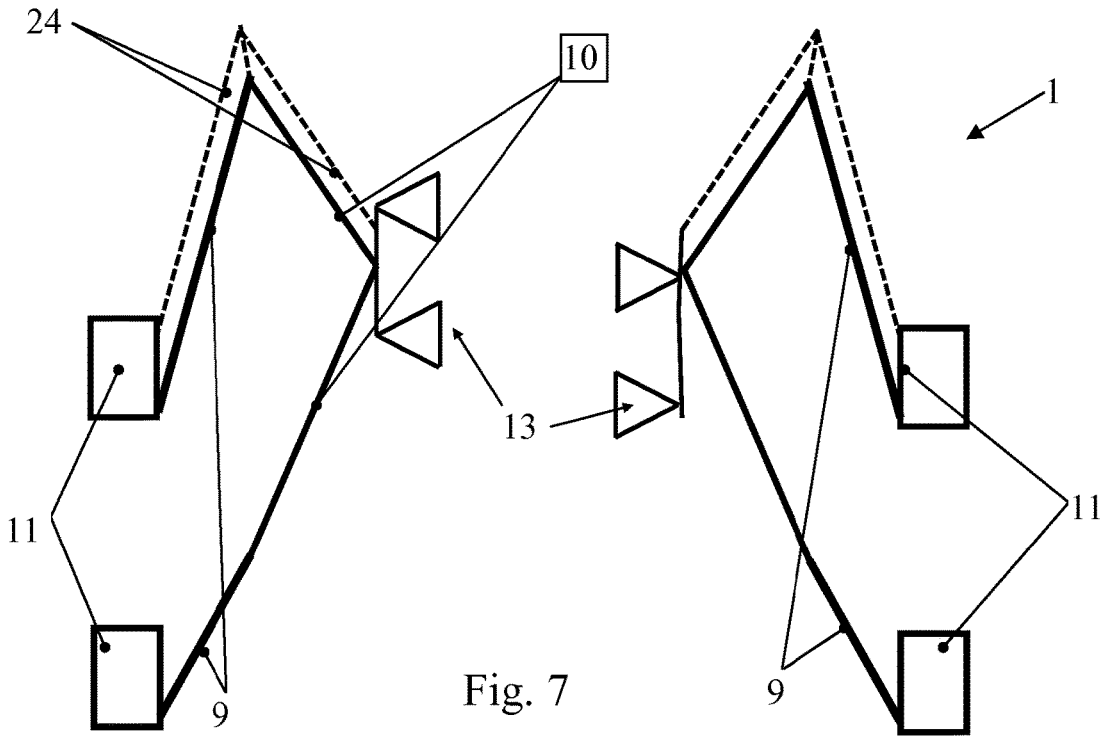

FIG. 6 shows the position of the positioning pivoting arms 9 and of the pivoting arms 10 in the third position 22. In the following, the direction of movement of the holders 12 will be reversed, wherein the holders 12 are temporarily stopped or decelerated in a fourth position 23. If the end region 7 of a successive bag body 8 is at the height of the first position 20, then the holders 12 will be moved into the first position 20, whereby the end region 7 of the next bag body 8 may be opened. FIG. 7 shows the position of the positioning pivoting arms 9 and the pivoting arms 10 in the fourth position 23. The two holders 12 move synchronously along the respective elliptical trajectory 18 thereof.

In a further embodiment variant, the holders 12 are moved in their trajectory temporarily before the third position 22 in regard to the bag body 8 in such a way so that these hold the end region 7 open and cannot further open it.

The FIGS. 4 to 7 schematically show positions of pivoting arms 10 and positioning pivoting arms 9 of the inventive invention 1, used in the system 40 according to FIG. 1, when passing the essentially elliptical trajectory 18 according to FIG. 3, with the holders 12.

In a preferred embodiment variant, the pivoting arms 10, the positioning pivoting arms 9 and the orienting arms 24 are formed by flat metal elements having recesses. Thereby there is obtained the advantage that the mass of the moved parts will be reduced, whereby there may be provided, on the one hand, small positioning drives 11, and, on the other hand, high conveying rates of the holders 12 may be reached.

The invention claimed is:

1. A device for opening an end region of a tubular bag body, wherein the end region extends between an open tube body end and a bottom central line, the device comprising:

a transporting device, on which the tubular bag body is transportable with adjacent tube walls in a bag conveying plane at a transport rate in a transporting direction, wherein the bottom central line is oriented in the transporting direction, suction devices arranged on both sides of the bottom central line, wherein the suction devices are driven so as to be movable transversely back and forth to the transporting direction and moveable to abut at the adjacent tube walls of the end region of the bag body situated therebetween and wherein the suction devices are then moveable apart from one another under exertion of a suction force onto the adjacent tube walls, pulling the adjacent tube walls apart from one another, wherein the suction devices are additionally moveable in and opposite to the transporting direction, wherein the suction devices are mounted at first articulate joints, wherein at each of the first articulate joints there are hinged two pivoting arms pivotable relative to one another, wherein each of the two pivoting arms is pivotingly connected to a positioning pivoting arm by means of a second articulate joint, wherein each of the two pivoting arms is driven movably.

2. The device according to claim 1, wherein each of the two pivoting arms is driven by its own positioning drive.

3. The device according to claim 1, wherein the positioning pivoting arms are driven pair-wise by a positioning drive, wherein there are interposed levers or gears between the positioning drive and at least one of the positioning pivoting arms.

4. The device according to claim 1, wherein the suction devices are moveable in a working plane, which is oriented at an acute angle ($\alpha$) to the bag conveying plane, wherein the acute angle ($\alpha$) is adjustable.

5. The device according to claim 4, wherein the suction devices are mounted on holders opposing one another, wherein the device has orienting arms, which hold the holders opposing one another in parallel with one another in case of a movement in the working plane.

6. The device according to claim 5, wherein the positioning pivoting arms, the pivoting arms and/or the orienting arms have at least one recess.

7. The device according to claim 5, wherein a rate component of the holders in the transporting direction, when opening the end region of the tubular bag body, corresponds to the transport rate.

8. The device according to claim 5 wherein each of the holders carries several suction devices, wherein the suction devices are arranged at each of the holders in at least one row.

9. The device according to claim 8, wherein the holders are configured adjustable such that the rows of suction devices are oriented in parallel to the bag conveying plane.

10. The device according to claim 1, wherein the suction devices may be moved in a circumferential trajectory having the following positions:

a first position, in which the suction devices rest at or adjacent the bottom central line at the adjacent tube walls of the end region of the bag body, a second position, in which the suction devices have been moved in regard to the first position in the transporting direction and away from each other, a third position, in which a suction effect of the suction devices is turned off, wherein the third position is situated at or adjacent a point of return of the circumferential trajectory from the movement in the transporting direction into a movement opposite to the transporting direction, and a fourth position, which is situated at or adjacent a point of return of the circumferential trajectory from the movement opposite to the transporting direction into a movement in the transporting direction.

11. The device according to claim 10, wherein the first positions of suction devices opposing one another in the transporting direction are arranged offset to one other.

12. The device according to claim 2, wherein the positioning drives are formed by stepping motors or servomotors.

13. A system for forming open bottoms at open end regions of tubular bag bodies, wherein each of the bag bodies has the end regions opposing one another, wherein, for opening each of the end regions, there is configured respectively one device according to claim 1 and wherein the devices are arranged offset to one another in the transporting direction of the bag bodies.

* * * * *